United States Patent [19]

Bain et al.

[11] 4,008,146

[45] Feb. 15, 1977

[54] METHOD OF SLUDGE DISPOSAL RELATED TO THE HOT WATER EXTRACTION OF TAR SANDS

[75] Inventors: Frederick A. Bain, Willowdale; John O. L. Roberts, Toronto, both of Canada

[73] Assignee: Great Canadian Oil Sands Limited, Toronto, Canada

[22] Filed: May 27, 1975

[21] Appl. No.: 580,853

[52] U.S. Cl. ..... 208/11 LE; 210/83

[51] Int. Cl.[2] ..... C10G 1/04

[58] Field of Search ..... 210/83, 73 R, 74, 259, 210/295; 208/11 LE

[56] References Cited

UNITED STATES PATENTS

| | | | |
|---|---|---|---|
| 3,392,833 | 7/1968 | Baillie | 208/11 LE |
| 3,502,566 | 3/1970 | Raymond et al. | 208/11 LE |
| 3,526,585 | 9/1970 | Camp | 210/44 |

*Primary Examiner*—Delbert E. Gantz
*Assistant Examiner*—James W. Hellwege
*Attorney, Agent, or Firm*—J. Edward Hess; Donald R. Johnson; James H. Phillips

[57] ABSTRACT

A method for reducing the sludge content of a retention pond associated with the hot water process for extracting bitumen from tar sands which comprises admixing a sludge stream containing at least 12% solids by weight with a hot water extraction process waste water stream containing at least 20% sand; settling the mixture in a settling zone to form an upper layer substantially reduced in mineral matter and a lower layer comprised of a sand-sludge mixture and dispersing said lower layer over a sand pile zone to provide additional sand layers thereon containing at least a part of the sludge in the interstices of said additional sand layers.

11 Claims, 2 Drawing Figures

METHOD OF SLUDGE DISPOSAL RELATED TO THE HOT WATER EXTRACTION OF TAR SANDS

CROSS REFERENCE TO RELATED APPLICATIONS

Figure 1:
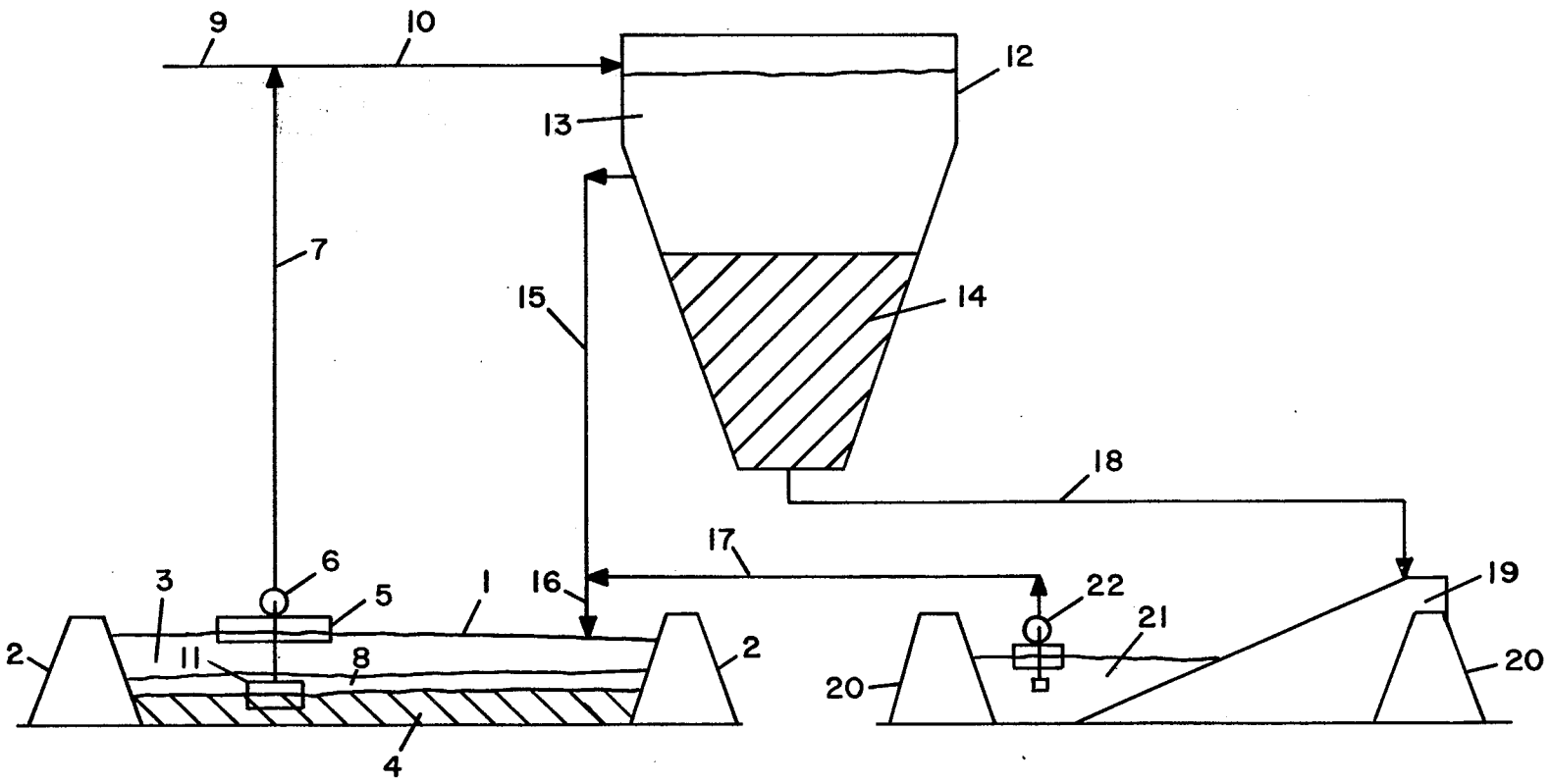

This application is related to our copending application Ser. No. 580,852 entitled "Method for Reducing Mineral Content of Sludge" filed of even date herewith.

BACKGROUND OF THE INVENTION

The present invention relates to a method for reducing the sludge content of a waste water retention pond associated with the hot water method of extracting bitumen from tar sands.

Tar sands, which are also known as oil sands and bituminous sands, are siliceous materials which are impregnated with a heavy petroleum. The largest and most important deposits of the sands are the Athabasca sands, found in northern Alberta, Canada. These sands underlay more than 13,000 square miles at a depth of 0 to 2,000 feet. Total recoverable reserves after extraction and processing are estimated at more than 300 billion barrels. Tar sands are primarily silica, having closely associated therewith an oil film which varies from about 5 to 21% by weight, with a typical content of 13 weight percent of the sand. The oil is quite viscous — 6 to 10° API gravity — and contains typically 4.5% sulfur and 38% aromatics. In addition to the oil and sand components, tar sands contain clay and silt in quantities of from 1 to 50 weight percent, more usually 10 to 30%. The sands also contain a small amount of water, in quantities of 1 to 10% by weight, in the form of a film around the sand grains.

Several basic extraction methods have been known for many years for the separation of oil from the sands. In the so-called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian Pat. No. 841,581 issued May 12, 1970, the bituminous sands are jetted with steam and mulled with a minor amount of hot water at temperatures of 170° to 190° F., and the resulting pulp is then dropped into a turbulent stream of circulating hot water and carried to a separation cell maintained at a temperature of about 185° F. In the separation cell, sand settles to the bottom as tailings and oil rises to the top in the form of a froth. An aqueous middlings layer comprising clay and silt and some oil is formed between these layers. This basic process may be combined with a scavenger step for further treatment of the middlings layer obtained from the primary separation step to recover additional amounts of oil therefrom.

The middlings layer, either as it is recovered from the primary process or as it is recovered after the scavenger step, comprises water, clay and oil. The oil content is, of course, higher in middlings which have not undergone secondary steps.

In the hot water extraction process as mentioned above, waste water streams are removed from the process plant as a slurry of about 35 to 75%, typically 45%, solids by weight. Included in the slurry is sand, silt, clay and small quantities of bitumen.

In this specification, sand is siliceous material which will not pass a 325 mesh screen. Silt will pass 325 mesh and is smaller than 45 microns but is larger than 2 microns. Clay is material smaller than 2 microns including some siliceous material of that size.

Because this waste water contains oil emulsions, finely dispersed clay with poor settling characteristics and other contaminents, water pollution considerations prohibit discarding the effluent into rivers, lakes or other natural bodies of water. The disposal of the waste water streams has therefore presented a problem.

Currently, waste water is stored in retention ponds which involve large space requirements and the construction of expensive enclosure dikes. A portion of the water in the waste water stream can be recycled back into the hot water extraction process as an economic measure to conserve both heat and water. However, experience has shown that the dispersed silt and clay content of the recycled water can reduce primary froth yield by increasing the viscosity of the middlings layer and retarding the upward settling of oil flecks. When this occurs, the smaller oil flecks and those that are more heavily laden with mineral matter stay suspended in the water of the separation cell and are removed from the cell with the middlings layer.

Waste water streams discharged from the hot water process for extracting bitumen from tar sands often called effluent discharge contain a substantial amount of mineral matter, much of which is colloidally dispersed in the effluent discharge and therefore does not settle very readily when stored in the retention pond. The lower layer of the retention pond can contain up to 50% dispersed mineral matter comprised substantially of clay and silt as well as up to 25% bitumen. This part of the pond water is normally referred to as sludge. Sludge is not suitable for recycling to the hot water extraction process for the reason that its addition into the separation cell or the scavenger cell at the normal inlet means would raise the mineral content of the middlings of the cell to the extent that recovery of bitumen would be substantially reduced. Generally, the settling which does take place in the pond provides a body of water in which the concentration of mineral matter increases substantially from the surface of the pond to the bottom thereof.

A waste water retention pond of the type herein described is normally formed over a reasonably long period of time. A hot water extraction plant for recovering bitumen from tar sands will produce between 12,000 and 25,000 imperial gallons per minute (IGPM) of waste water streams which are stored in the pond. Concurrently of course, some of the pond water, i.e., that containing less than 5% mineral matter, can be recycled to the hot water extraction process to therefore reduce the overall volume increase per operating hour of water stored in the retention pond.

Experience has shown that, as the pond forms, the various components in the effluent discharge settle in the pond at varying rates. As an example, when the waste water containing sand, silt, clay and bitumen is discharged to the pond, the free bitumen normally immediately floats to the surface of the pond as bituminous froth and the sand immediately settles to the bottom of the pond. However, after the surface bituminous froth cools and releases the entrapped air which originally caused it to float, it too will begin to settle toward the bottom of the pond. The silt and clay in the discharge settle in the pond at a substantially low rate as compared to the sand.

Thus to characterize a pond, it can be pictured as a large body of water containing dispersed solids which are slowly settling toward the bottom of the pond. The dispersed solids in the pond are in a constant but slow state of settling. Normally, the pond is constantly increasing in size because of the continuous addition of waste water, and therefore the character of the pond is continually changing.

In processing tar sands to recover bitumen therefrom, the tar sands are excavated, extracted to remove the bitumen, whereafter the sand and other minerals are returned to the excavated area. As noted above, waste waters associated with the extraction step must be stored in a retention pond which is normally placed in one of the excavated areas. It is important that the excavated area be filled only with minerals and not with water since obviously the water is excess and therefore requires more storage volume than is available. If a retention pond associated with the hot water extraction of bitumen from tar sands is not treated to remove water layers which cannot be reused, such as sludge, the problem of a shortage of storage space is ever present.

As one example, a waste water retention pond associated with a hot water process for extracting bitumen from 140,000 to 150,000 tons of tar sands per day and having a surface area of about 1,000 acres and an average depth of 40 feet can be characterized somewhat as follows:

a. From the surface of the pond to a depth of about 15 feet the mineral concentration which is primarily clay is found to be about 0.5 to 5.0 weight percent. This pond water can normally be recycled to a hot water extraction process without interfering with the extraction of bitumen from tar sands.
b. The layer of water in the pond between 15 and 25 feet from the surface contains between 5.0 and 20% mineral matter. This water, if recycled to the separation cell feed with fresh tar sands, would increase the mineral content of the middlings portion of the cell to the point that little bitumen would be recovered.
c. Finally, the section of the pond between 25 feet and the bottom of the pond contains 20 to 50% mineral matter and is normally referred to as sludge.

Many procedures for treating waste waters associated with the extraction of bitumen from tar sands have been proposed. For example Canadian Pat. No. 841,582 issued May 12, 1970 to Robert A. Baillie claims a method for recovering additional bitumen from waste water streams recovered from a tar sands hot water extraction process comprising settling the stream and removing floating bitumen from the surface thereof.

Canadian Pat. No. 824,968 issued Oct. 14, 1969 to Robert A. Baillie discloses a treatment of waste water from a hot water extraction process which comprises percolating the waste water through an inclined sand pile to incorporate the clay and silt of the waste water into the interstices of the sand pile.

Canadian Pat. No. 866,266 issued Mar. 16, 1971 to Raymond et al. discloses removing bitumen from waste water streams by incorporating viable microorganisms therein which subsequently results in clay settling. Canadian Pat. Nos. 873,317 issued June 16, 1971 to Baillie et al.; 873,318 issued June 16, 1971 to Baillie et al.; 873,853 issued June 22, 1971 to Baillie et al.; 874,418 issued June 29, 1971 to Camp; 874,419 issued June 29, 1971 to Steinmetz, 878,656 issued Aug. 17, 1971 to Seitzer et al.; 882,668 issued Oct. 5, 1971 to Camp; 890,804 issued Jan. 18, 1972 to Fear et al.; 891,472 issued Jan. 25, 1972 to Camp; 892,548 issued Feb. 8, 1972 to Hepp et al. and 917,586 issued Dec. 26, 1972 to Paulson each disclose methods for treating waste water streams associated with the hot water method for extracting bitumen from tar sands. Yet none of these proposals provides an economically attractive process for treating hot water extraction process waste waters associated with the recovery of bitumen from tar sands. By the method of the present invention an improved process for resolving this problem is provided.

DESCRIPTION OF THE INVENTION

The present invention relates to a process for reducing the quantity of sludge and in particular clay dispersed in a waste water retention pond associated with the hot water process for extracting bitumen from tar sands.

Specifically, the present invention provides a method whereby sludge withdrawn from a hot water extraction retention pond is admixed with a hot water extraction process waste water stream containing at least 20% sand and is thereafter incorporated into a sand beach thereby removing at least a part of the sludge from the pond water storage area.

An object of the present invention is to incorporate retention pond sludge as herein defined and, more importantly, clay contained in that sludge, into the interstices of an inclined sand pile zone and thus reduce the volume of sludge in that pond. Basically, this object is achieved by admixing a stream of sludge with an aqueous stream containing at least 20% sand and thereafter dispersing a resulting sand and sludge mixture over an inclined sand pile zone.

Generally, the present invention is a method whereby sludge from a hot water extraction retention pond is admixed with an effluent discharge stream from a hot water extraction process containing at least 20% sand and thereafter settled to form a lower sludge-sand layer and an upper aqueous layer. The lower layer is thereafter dispersed over an inclined sand pile zone to form additional sand layers on the sand pile having sludge in the interstices thereof. By this procedure the sand settled in the sand pile zone contains substantially more clay than sand settled from a hot water extraction process waste water stream. The upper layer from the settling zone can be transferred to a storage zone, as for example, the retention pond for subsequent settling and use of water released in the hot water extraction process.

FIG. 1 of the present specification provides a flow diagram of one mode of the process of the present invention including reduction of sludge and more importantly of clay contained in that sludge from a hot water extraction retention pond.

Figure 2:
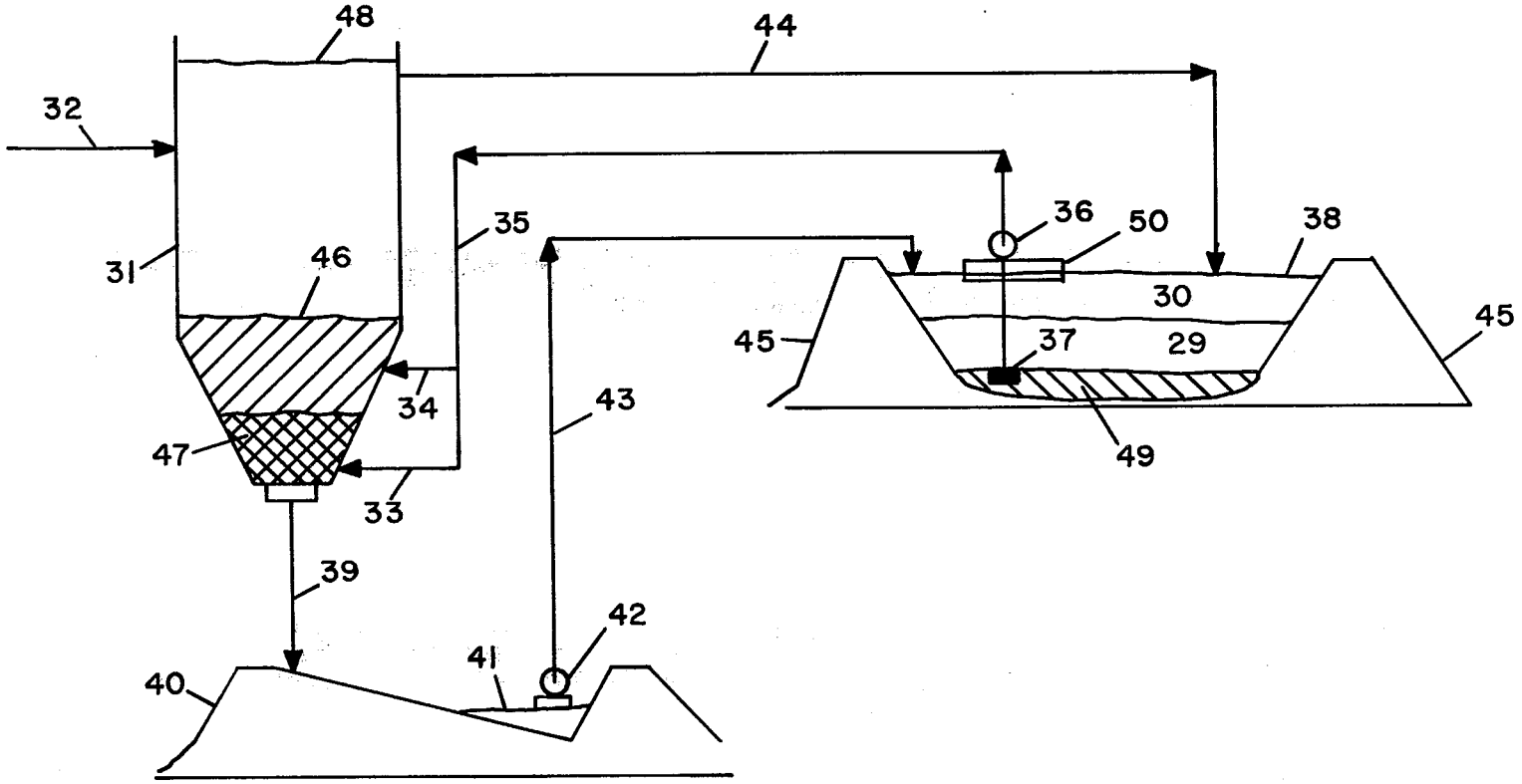

FIG. 2 provides an illustration of another mode of the method of the present invention providing for the reduction of sludge from a waste water pond associated with the hot water extraction of bitumen from tar sands.

Specifically, the present invention comprises withdrawing sludge material from a retention pond, admixing the sludge material with a waste water stream from the hot water extraction process containing at least 20% sand and thereafter settling the sludge-waste water stream in a settling zone. The sludge-waste water mixture can be in the range of 0.1 to 10.0 volumes of sludge per volume of waste water with the range of 0.5 to 5.0 volumes of sludge per volume of waste water being preferred.

It is preferred that the sludge contains 12 to 30 weight percent dispersed mineral for effective settling of a sand-sludge mixture on a sand pile zone whereby a part of the sludge remains in the sand layer interstices.

In the settling zone a supernatant water layer forms and a lower, more dense, sand-sludge layer forms. The supernatant layer comprises water substantially reduced in coarse sand. This water can be recycled to the retention pond to be resettled and thereby provide additional water for use in the hot water extraction process. The lower layer of the settling zone comprises a mixture of solids from each stream which can be transferred to an inclined beach of sand. When disposed on this sand beach, the sand in this stream forms additional sand layers which incorporate clay and slit and water of the sludge of the stream into the interstices of the sand layer. Therefore, the amount of silt and more importantly of clay in the aqueous portion of a hot water extraction retention pond is reduced. By this procedure, the sludge layer of a retention pond can be continuously treated to reduce its volume and provide additional water for reuse in the hot water extraction process.

EXAMPLE 1

As one means of further defining a particular aspect of the process of the present invention, the following example in relation to FIG. 1 attached is provided. Referring to the figure, a hot water extraction process retention pond 1 is enclosed by dike walls 2 and contains pond water layers 3 and 8 and sludge layer 4. The retention pond is associated with a hot water extraction process for processing 140,000 to 150,000 tons per day of tar sands which provides 15,000 to 30,000 IGPM of effluent discharge waste water streams.

Sludge material comprised of about 4.3% bitumen, 0.9 % sand, 17.8% silt, 7.7% clay and 69.3% water is withdrawn from pond 1 via sludge withdrawal means 11 and transferred to line 7 via pump 6 situated on flotation means 5 on the surface of pond 1. The sludge material from pump 6 is transferred via line 7 into line 10 where it is combined with tailings material from the hot water extraction process for recovering bitumen from tar sands, not shown. This waste water stream from the extraction process is comprised of about 0.6% bitumen, 42.7% sand, 3.3% silt, 2.4% clay and 51% water. The sludge is pumped at about 36,900 IGPM and the tailings material is added at about 23,600 IGPM. The combined streams providing about 60,500 IGPM of aqueous effluent comprised of about 2.7% bitumen, 18.9% sand, 11.5% silt, 5.4% clay and 61.5% water. This composition is transferred from line 10 into settling zone 12.

In settling zone 12 an upper layer 13 is formed and a lower layer 14 is formed. The upper layer which is comprised of about 3.5% bitumen, 1.0% sand, 13.9% silt, 6.6% clay and 75.3% water is withdrawn at the rate of about 35,300 IGPM via line 15 and transferred into line 16 where it can be combined with beach run-off water hereinafter defined from zone 21 via line 17 and added to retention pond 1.

Lower layer 14 in settling zone 12 is withdrawn via line 18 and transferred at about 25,200 IGPM to an inclined sand pile zone 19 situated adjacent to dike 20. The lower layer 14 of settling zone 12 is comprised of about 2.1% bitumen, 38.7% sand, 8.9% silt, 4.0% clay and 46.2% water. This stream is dispersed over the sand pile to form additional sand layers whereby a part of the clay, silt and water in this stream is retained in the interstices of the sand layers. The remainder of the aqueous stream percolates down the inclined sand pile zone and settles into retention zone 21. A pump 22 in retention zone 21 withdraws the aqueous portion of that pond and transfers it into line 17 where it can be combined with the upper layer of zone 12 in line 16. The stream in line 17 is pumped at about 14,800 IGPM and is characterized as containing about 2.9% bitumen, 0.6% sand, 14.5% silt, 6.4% clay and 75.6% water.

By utilizing this method of the present invention, a part of the sludge from retention pond 1 is removed and is dispersed with the sand of a waste water stream of a hot water extraction process over a sand pile such as a pond dike wall. By this method, sludge withdrawn from the pond can be stored in the interstices of sand pile zone 19 thereby providing a means for reducing the solids content and, more importantly, clay content of retention pond 1. By this procedure, more effective storage of the solids and, more importantly, of clay associated with the hot water extraction of bitumen from tar sands is accomplished than is the case when sand is settled from an extraction process waste water stream. As shown in FIG. 1, retention pond 1 and retention zone 21 can be one zone wherein the sand pile is located on dike walls 2 of retention pond 1. In that manner, only one retention pond is necessary to conduct the whole process.

EXAMPLE 2

As an alternate method, the process illustrated in the drawing in FIG. 2 is provided. Referring to the drawing, retention pond 38 is enclosed by dike walls 45 and contains sludge layer 49 and pond water layers 29 and 30. This pond is used to store waste water discharge streams from a hot water extraction method for recovering bitumen from tar sands wherein 140,000 to 150,000 tons per day of tar sands are processed, which provides about 15,000 to 30,000 IGPM of waste water to the pond.

A hot water process waste water stream is provided to the upper section of settling zone 31 via line 32. The stream contains 0.5% bitumen, 42.6% sand, 3.2% silt, 2.4% clay and 51.4% water. The feed rate of this stream is about 23,600 IGPM.

Retention pond sludge is withdrawn from pond 38 via sludge recovery means 37 and transferred to line 35 via pump 36 disposed on flotation means 50 on the pond surface. Sludge is transferred at about 22,600 IGPM into line 35 and thereafter divided so that a part is transferred into the bottom of zone 31 through line 33 and another part is transferred into an intermediate section between the upper and lower parts of zone 31 via line 34. Settling zone 31, as illustrated, contains upper aqueous layer 48, sand settling layer 46 and sand-sludge layer 47. These layers are formed by the addition of sludge through lines 33 and 34 at the designated sections of settling zone 31 combined with the addition of the defined waste water stream from line 32.

In the process, sand entering zone 31 from line 32 settles by gravity down through aqueous layer 48 to form sand layer zone 46. Sand layer zone 46, which is continually being formed by sand settling, continuously moves downwardly mixing with pond sludge added via lines 34 and 33. The sludge-sand mixture 47 is withdrawn via line 39 and transferred to sand pile zone 40. Sludge can optionally also be added by a single line into the lower section of zone 31 and achieve similar results.

As sand in layer 46 moves downwardly in zone 31, the sand admixes with the sludge from lines 34 and 33 to form sand-sludge layer 47. A small proportion of the sludge preferably can move upwardly and combine with the water in layer 48. The major proportion of the sludge becomes associated with the sand which is carried out of the zone through discharge line 39 and dispersed over sand pile zone 40 to form additional sand layers thereon. By this process sludge is disposed in the interstices of a sand pile zone to thereby incorporate its solids content and, more importantly, its clay content in the interstices of the sand pile zone. The sand-sludge layer 47 is withdrawn at about 27,700 IGPM and contains about 1.8% bitumen, 36.2% sand, 8.1% silt, 5.3% clay and 48.6% water.

Aqueous layer 48 is withdrawn via line 44 at the rate of about 18,500 IGPM and is characterized as containing 0.9% bitumen, 0.4% sand, 5.4% silt, 4.3% clay and 89.0% water. This stream is returned to retention pond 38 whereupon settling will provide water which will be suitable for use in a hot water extraction process.

The aqueous run-off from sand pile zone 40 is collected in area 41 and transferred via pump 42 through line 43 to retention pond 38. The stream in line 43 is transferred at about 17,100 IGPM and contains 2.8% bitumen, 0.6% sand, 12.5% silt, 8.4% clay and 75.8% water. About 10,600 IGPM of the sand-sludge stream containing about 70% sand is retained on sand pile zone 40. This quantity of effluent in the sand pile zone, exclusive of the sand, represents the amount of sludge which would otherwise occupy a part of the pond volume if no sludge and, more importantly, no clay had been incorporated into the interstices of the sand pile zone.

The hot water extraction process waste water stream suitable for use in the process of the present invention should contain at least 20% sand. The sludge stream processed in this invention should contain at least 12% solids including at least 5% clay, as well as sand, silt and bitumen. All parts and percentages herein provided are by weight unless otherwise stated.

Thus the present invention generally provides a method for processing sludge recovered from a retention pond associated with the hot water extraction of bitumen from tar sands which comprises:

a. admixing a retention pond sludge stream containing at least 12% solids including sand, silt, clay and bitumen with a waste water stream containing at least 20% sand; and b. dispersing said mixture over an inclined sand pile zone to provide additional sand layers thereon having at least a part of the sludge of the sand-sludge mixture within the interstices of said additional sand layers.

More specifically, the present invention comprises a method for processing sludge recovered from a retention pond associated with the hot water extraction of bitumen from tar sands which comprises:

a. admixing a retention pond sludge stream containing at least 12% solids including sand, silt, clay and bitumen with a waste water stream containing at least 20% sand, said waste water stream being recovered from a hot water extraction process for recovering bitumen from tar sands;

b. settling said mixture of streams in a settling zone to form an upper layer substantially free of sand and a lower layer comprised of an aqueous sand-sludge mixture; and c. dispersing said lower layer over an inclined sand pile zone to provide additional sand layers thereon having at least a part of the sludge of the sand-sludge mixture within the interstices of said additional sand layers.

In particular a preferred embodiment of the present invention comprises a method for processing waste water streams and retention pond sludge associated with the hot water extraction of bitumen from tar sands which comprises:

a. feeding a hot water extraction process waste water stream containing at least 20% sand to the upper zone of a settling cell;

b. feeding a pond sludge stream containing at least 12% solids to the lower zone of said settling cell;

c. settling said streams in said cell to provide an upper layer comprised substantially of water, bitumen and mineral matter substantially free of coarse sand and a lower layer comprised substantially of a sludge-sand mixture; and d. transferring said lower layer to an inclined sand pile zone to form additional sand layers thereon and concurrently incorporating at least a part of said sludge in the interstices of said additional sand layers.

The invention claimed is:

1. In a hot water process for extracting bitumen from tar sands wherein a waste water stream containing at least 20% sand by weight is discharged and in which a retention pond having a sludge layer is employed to store waste water, the method of reducing the sludge content of the material stored in the retention pond comprising the steps of:

A. withdrawing a sludge stream containing at least 12% solids by weight from the retention pond sludge layer;

B. admixing the sludge stream with the waste water stream;

C. settling the mixture of streams in a settling zone to form a substantially aqueous upper layer and a lower layer comprised of an aqueous/sand/sludge mixture; and D. dispensing the aqueous/sand/sludge mixture over an inclined sand pile zone to provide additional sand layers thereon having at least a part of the sludge in the mixture entrapped within the interstices of the sand layers.

2. A method according to claim 1 wherein the inclined sand pile is employed as a pond wall whereby the portion of the aqueous/sand/sludge mixture which is neither entrapped in the interstices of the sand layers nor evaporates is collected in a pond.

3. A method according to claim 2 wherein the pond of which the inclined sand pile is employed as a wall is separate from the retention pond.

4. The method of claim 3 which includes the additional step of transferring water from the separate pond to the retention pond.

5. The method of claim 1 which includes the additional step of pumping fluid from the substantially aqueous upper layer in the settling zone to the retention pond.

6. The method of claim 1 wherein the pond of which the inclined sand pile is employed as a wall is the retention pond.

7. In a hot water process for extracting bitumen from tar sands wherein a waste water stream containing at least 20% sand by weight is discharged and in which a retention pond having a sludge layer is employed to store waste water, the method of reducing the sludge content of the material stored in the retention pond comprising the steps of:

A. feeding the waste water stream to an upper zone of a settling cell;

B. withdrawing a sludge stream containing at least 12% solids by weight from the retention pond sludge layer;

C. feeding the sludge stream to a zone of the settling cell lower than the zone into which the waste water is fed;

D. settling the streams in the cell to provide a substantial aqueous upper layer and a lower layer comprised substantially of an aqueous/sludge/sand mixture; and E. transferring quantities of the aqueous/sand/sludge mixture to an inclined sand pile zone to form additional sand layers thereon, thereby disposing at least a part of the sludge in the aqueous/sand/-sludge mixture in the interstices of the sand layers.

8. A method according to claim 7 which includes the additional step of pumping fluid from the substantially aqueous upper layer in the settling cell to the retention pond.

9. A method according to claim 7 wherein the inclined sand pile is employed as a pond wall whereby the portion of the aqueous/sand/sludge mixture which is neither entrapped in the interstices of the sand layers nor evaporates is collected in a pond.

10. A method according to claim 2 wherein the pond of which the inclined sand pile is employed as a wall is separate from the retention pond.

11. The method of claim 10 which includes the additional step of transferring water from the separate pond to the retention pond.

* * * * *